US007847767B2

(12) United States Patent
Chiou

(10) Patent No.: US 7,847,767 B2
(45) Date of Patent: Dec. 7, 2010

(54) PIXEL CIRCUIT

(75) Inventor: Yu-Wen Chiou, Sinshih Township (TW)

(73) Assignee: Himax Technologies Limited, Sinshih Township (TW)

( * ) Notice: Subject to any disclaimer, the term of this patent is extended or adjusted under 35 U.S.C. 154(b) by 697 days.

(21) Appl. No.: 11/623,851

(22) Filed: Jan. 17, 2007

(65) Prior Publication Data

US 2008/0170053 A1 Jul. 17, 2008

(51) Int. Cl.
*G09G 3/32* (2006.01)

(52) U.S. Cl. ..... 345/82

(58) Field of Classification Search ..... 345/76–83, 345/30; 365/226
See application file for complete search history.

(56) References Cited

U.S. PATENT DOCUMENTS 6,535,185 B2 * 3/2003 Kim et al. ..... 345/76
2003/0184509 A1 * 10/2003 Chen et al. ..... 345/90
2004/0056828 A1 * 3/2004 Choi et al. ..... 345/82
2005/0007361 A1 * 1/2005 Fujikura et al. ..... 345/204
2006/0023551 A1 * 2/2006 Peng et al. ..... 365/226

* cited by examiner

*Primary Examiner*—Chanh Nguyen
*Assistant Examiner*—Tsegaye Seyoum

(57) ABSTRACT

A pixel circuit has a light emitting diode, a first driving transistor, a second driving transistor, a capacitor, and a switch unit. When a scan signal is asserted, the switch unit couples sources/drains of the second driving transistor respectively to a first and a second source/drain of the first driving transistor, and couples a gate and second source/drain of the first driving transistor together. When the scan signal is de-asserted, the switch unit decouples one of the sources/drains of the second driving transistor from the first/second source/drain of the first driving transistor, and decouples the gate from the second source/drain of the first driving transistor.

4 Claims, 13 Drawing Sheets

PIXEL CIRCUIT

BACKGROUND

1. Field of Invention

The present invention relates to a pixel circuit, and more particularly relates to an AMOLED pixel circuit including a capacitor for sustaining light emission of the OLED.

2. Description of Related Art

FIG. 1 shows an organic light emitting diode pixel circuit of prior art. The pixel circuit has a light emitting diode 180, a driving transistor 140, a, and a capacitor 130, and a switch unit (transistor 160). The driving transistor 140 has a first source/drain 141 coupled to a first end 181 of the light emitting diode 180. The capacitor 130 is coupled between the gate and the first source/drain 141 of the first driving transistor 140. When a scan signal is asserted, the transistor 160 couples the gate and the second source/drain 142 of the first driving transistor 140 together. When the scan signal is de-asserted, the transistor 160 decouples the gate from the second source/drain 142 of the first driving transistor 140.

The pixel circuit also has a scan switch 110 coupled to a data line 120 and is controlled by the scan signal. The second source/drain 142 of the first driving transistor 140 is coupled to a power source terminal 190.

The drawback of the conventional pixel circuit is that it spends a relatively long time for the capacitor 130 to be charged to a required level, especially for low gray scale level images. Therefore, a pixel circuit with high data writing speed is needed.

SUMMARY

According to one embodiment of the present invention, the pixel circuit has a light emitting diode, a first driving transistor, a second driving transistor, a capacitor and a switch unit. The first driving transistor has a first source/drain coupled to one end of the light emitting diode. The second driving transistor has a gate coupled to a gate of the first driving transistor, wherein the gate width of the second driving transistor is smaller than the gate width of the first driving transistor. The capacitor is coupled between the gate and the first source/drain of the first driving transistor. When a scan signal is asserted, the switch unit couples the sources/drains of the second driving transistor respectively to the first and a second source/drain of the first driving transistor, and couples the gate and second source/drain of the first driving transistor together. When the scan signal is de-asserted|, the switch unit decouples one of the sources/drains of the second driving transistor from the first/second source/drain of the first driving transistor, and decouples the gate from the second source/drain of the first driving transistor.

According to another embodiment of the present invention, the pixel circuit has a light emitting diode, a first driving transistor, a second driving transistor, a capacitor and a switch unit. The first driving transistor has a first source/drain coupled to one end of the light emitting diode. The second driving transistor has a gate coupled to a gate of the first driving transistor, wherein the gate width of the second driving transistor is smaller than the gate width of the first driving transistor. The capacitor is coupled between the gate and a second source/drain of the first driving transistor. When a scan signal is asserted, the switch unit couples sources/drains of the second driving transistor respectively to the first and a second source/drain of the first driving transistor, and couples the gate and first source/drain of the first driving transistor together. When the scan signal is de-asserted, the switch unit decouples one of the sources/drains of the second driving transistor from the first/second source/drain of the first driving transistor, and decouples the gate from the first source/drain of the first driving transistor.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
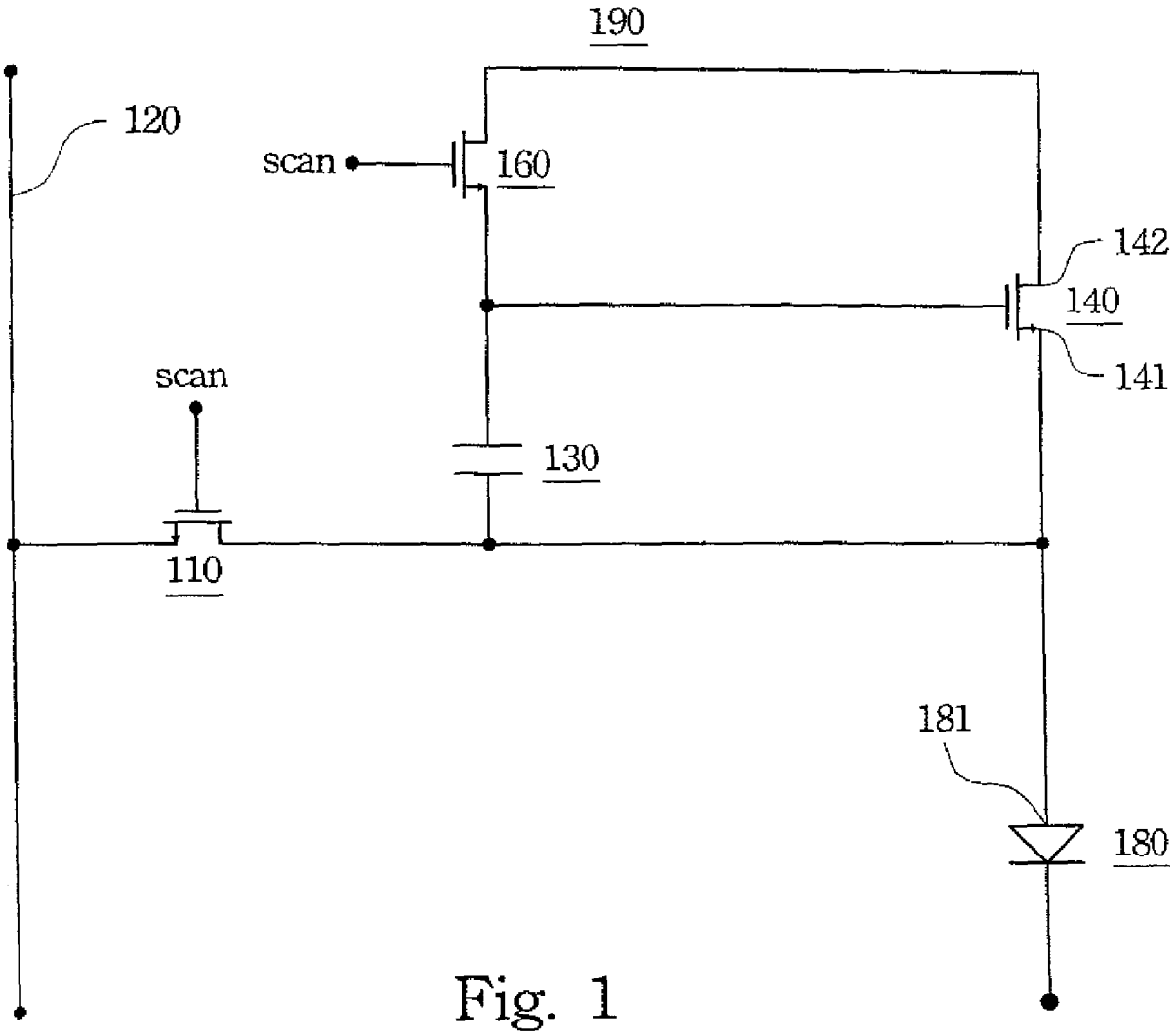
Fig. 1 (prior art)
FIG. 1 shows an organic light emitting diode pixel circuit of the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
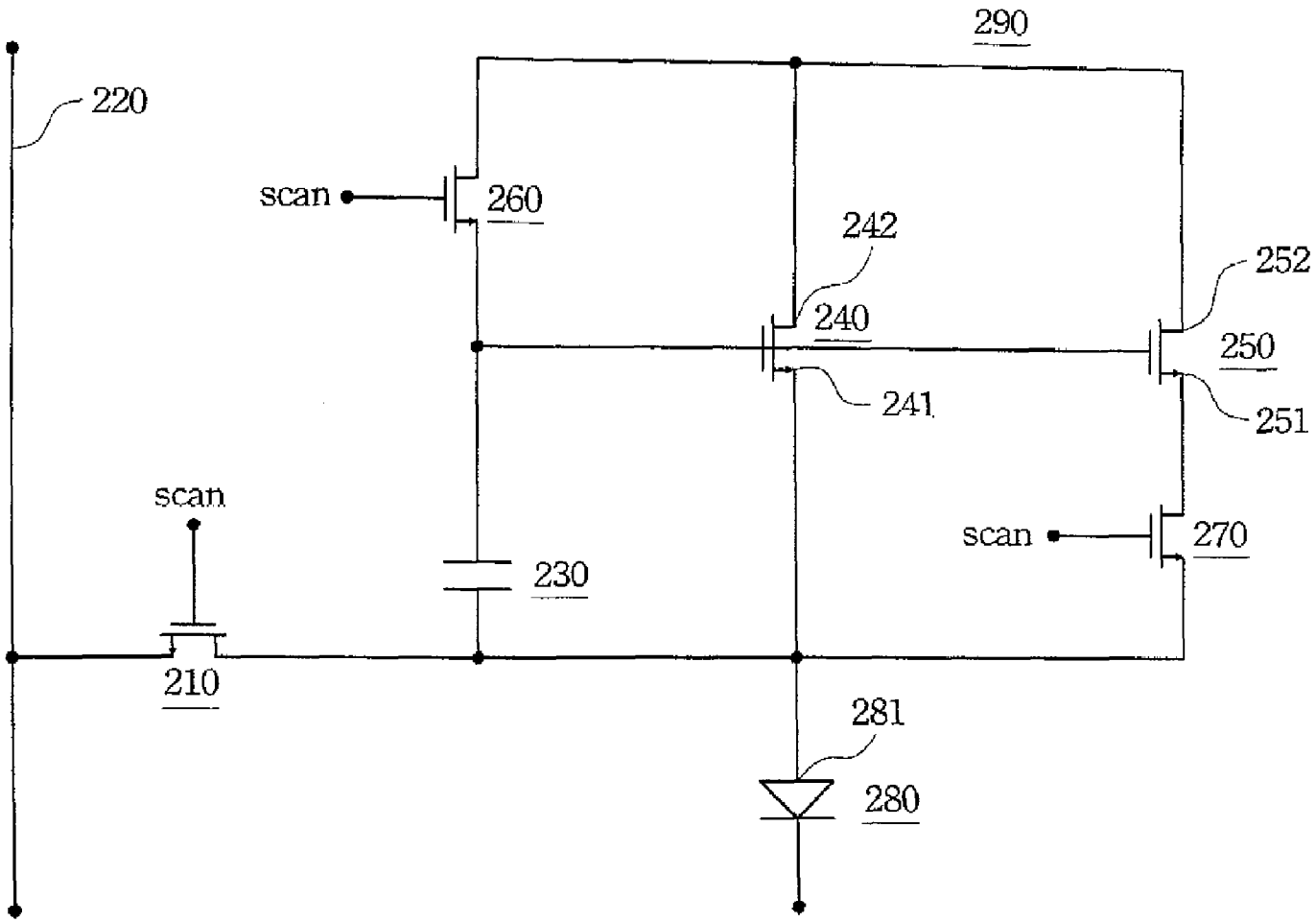
FIG. 2A shows an organic light emitting diode pixel circuit according to the first embodiment of the invention.

FIG. 2A shows an organic light emitting diode pixel circuit according to a first embodiment of the invention. The pixel circuit has a light emitting diode 280, a first driving transistor 240, a second driving transistor 250, a capacitor 230, and a switch unit. The first driving transistor 240 has a first source/drain 241 coupled to a first end 281 of the light emitting diode 280. The second driving transistor 250 has a gate coupled to a gate of the first driving transistor 240, wherein the gate width of the second driving transistor 250 is smaller than the gate width of the first driving transistor 240. The capacitor 230 is coupled between the gate and the first source/drain 241 of the first driving transistor 240.

The switch unit has two transistors 260 and 270. When a scan signal is asserted, the switch unit couples the first source/drain 251 of the second driving transistor 250 to the first source/drain 241 of the first driving transistor 240, and couples the gate and the second source/drain 242 of the first driving transistor 240 together. When the scan signal is de-asserted, the switch unit decouples the first sources/drain 251 of the second driving transistor 250 from the first source/drain 241 of the first driving transistor 240, and decouples the gate from the second source/drain 242 of the first driving transistor 240.

The pixel circuit further has a scan switch 210 coupled between a data line 220 and light emitting diode 280, wherein the scan switch is controlled by the scan signal. Therefore, when the scan signal is asserted, the driving current signal from the data line 220 charges the capacitor 230.

The second source/drain 242 of the first driving transistor 240 is coupled to a power source terminal 290, and a voltage of the power source terminal 290 changes oppositely to a voltage of the scan signal.

The switch units, first driving transistor, second driving transistor, and the scan switch can be implemented by MOS transistors. In this embodiment, the switch unit configured with transistors 260 and 270, the first driving transistor 240, the second driving transistor 250, and the scan switch 210 are NMOS transistors.

Figure 2B:
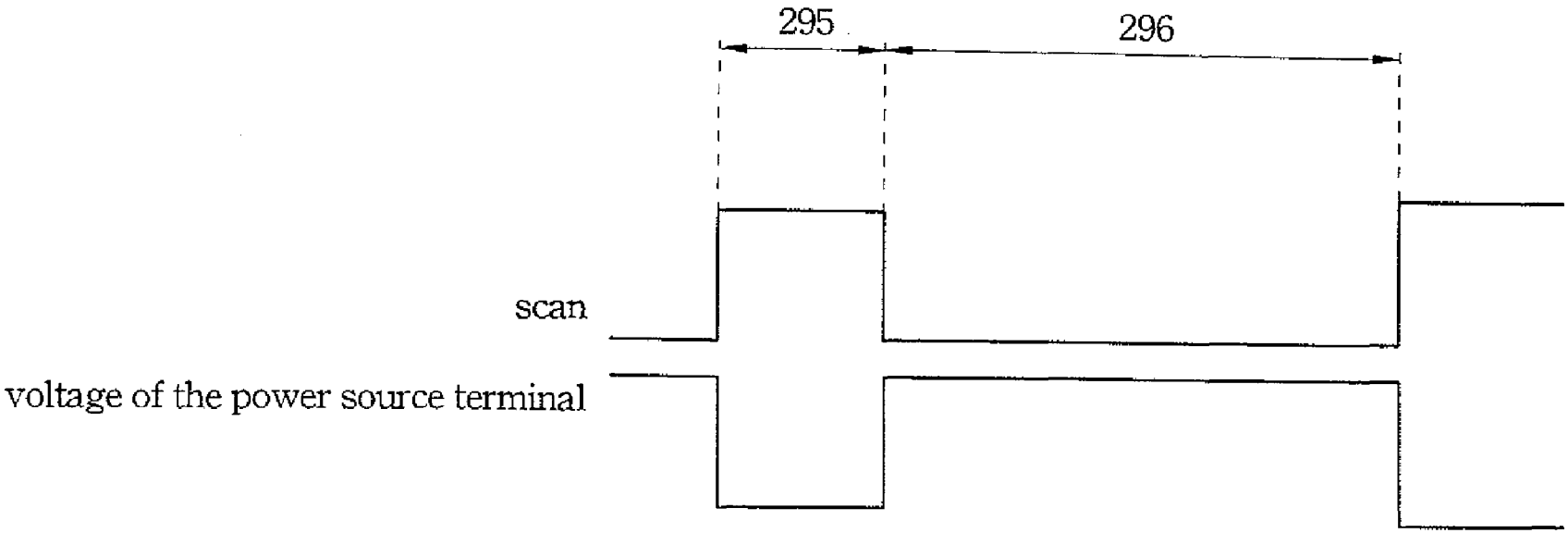
FIG. 2B shows the waveforms of the first embodiment of the invention shown in FIG. 2A.

FIG. 2B shows the waveforms of the first embodiment of the invention shown in FIG. 2A. In the period 295, the scan signal is asserted (i.e. the scan signal is a high voltage), and the voltage of the power source terminal 290 is a low voltage. Thus, the driving current from the data line 220 charges the capacitor 230 more efficiently.

Moreover, the ratio of the gate width of the first driving transistor 240 to that of the second driving transistor 250 influences the length of the duration for the capacitor 230 to be charged to a desired level. More specifically, if the ratio increases from 1 to 5, the duration is shortened by ⅕ times. Thus, the ratio can be properly selected so that the duration is short enough even for low gray scale level images.

The transistors 270 of the switch unit is arranged to couple or decouple the driving transistor with the smaller gate width (i.e. the second driving transistor 250) to the light emitting diode 280. In the period 296, the scan signal is de-asserted, and the transistor 270 decouples the second driving transistor 250 from the light emitting diode 280. Therefore, the first driving transistor 240 with the bigger gate width drives the light emitting diode 280 to display the image.

Figure 3:
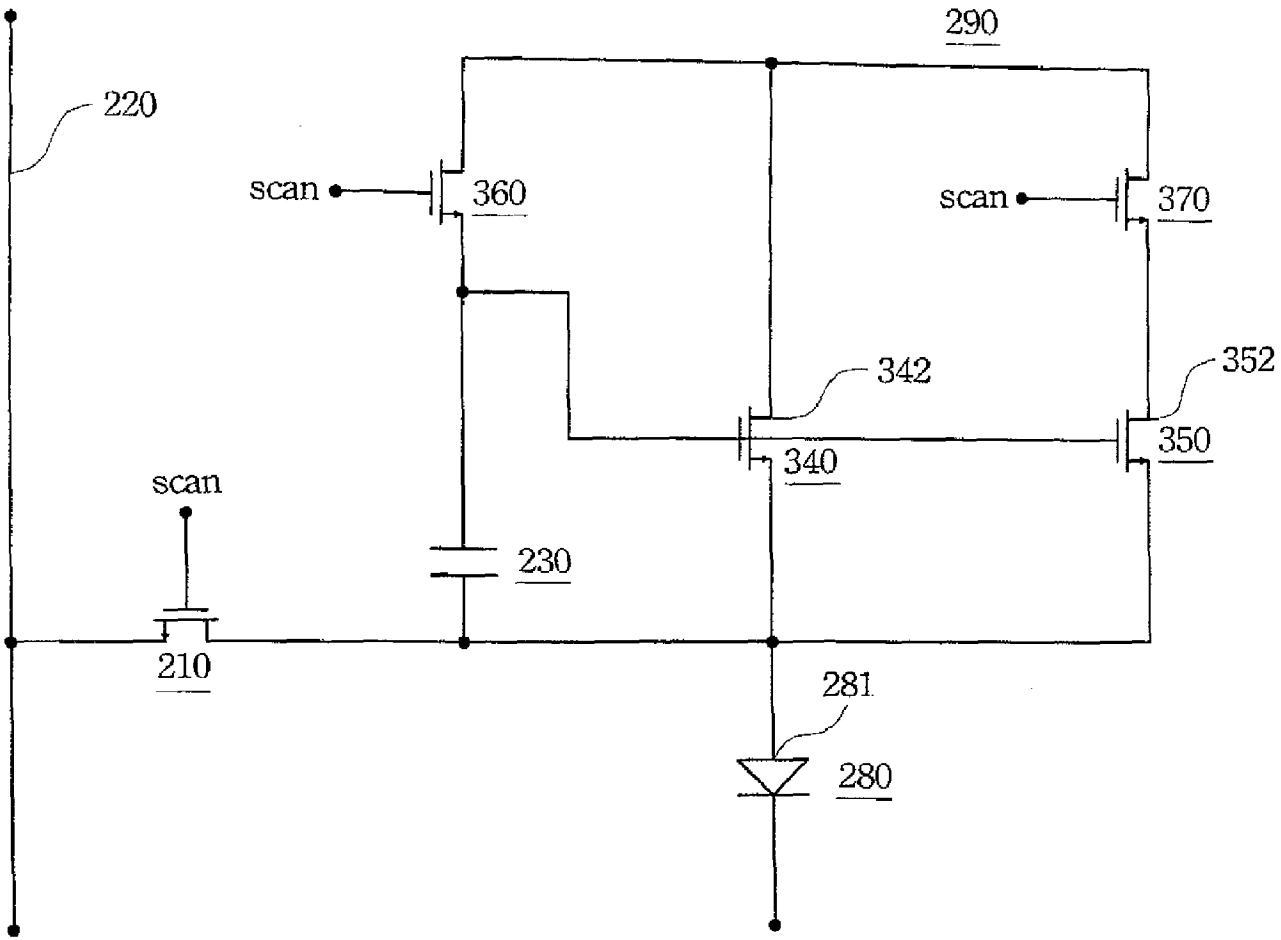
FIG. 3 shows an organic light emitting diode pixel circuit according to the second embodiment of the invention.

FIG. 3 shows an organic light emitting diode pixel circuit according to the second embodiment of the invention. The pixel circuit is configured with NMOS transistors, and the gate width of the second driving transistor 350 is smaller than the gate width of the first driving transistor 340. The difference between the pixel circuits of FIG. 3 and FIG. 2A is that the transistor 370 of FIG. 3 is coupled between the power source terminal 290 and the second driving transistor 350.

The switch unit has transistors 360 and 370. When a scan signal is asserted, the switch unit couples the second source/drain 352 of the second driving transistor 350 to the second source/drain 342 of the first driving transistor 340, and couples the gate and the second source/drain 342 of the first driving transistor 340 together. When the scan signal is de-asserted, the switch unit decouples the second sources/drain 352 of the second driving transistor 350 from the second source/drain 342 of the first driving transistor 340, and decouples the gate from the second source/drain 342 of the first driving transistor 340.

Figure 4:
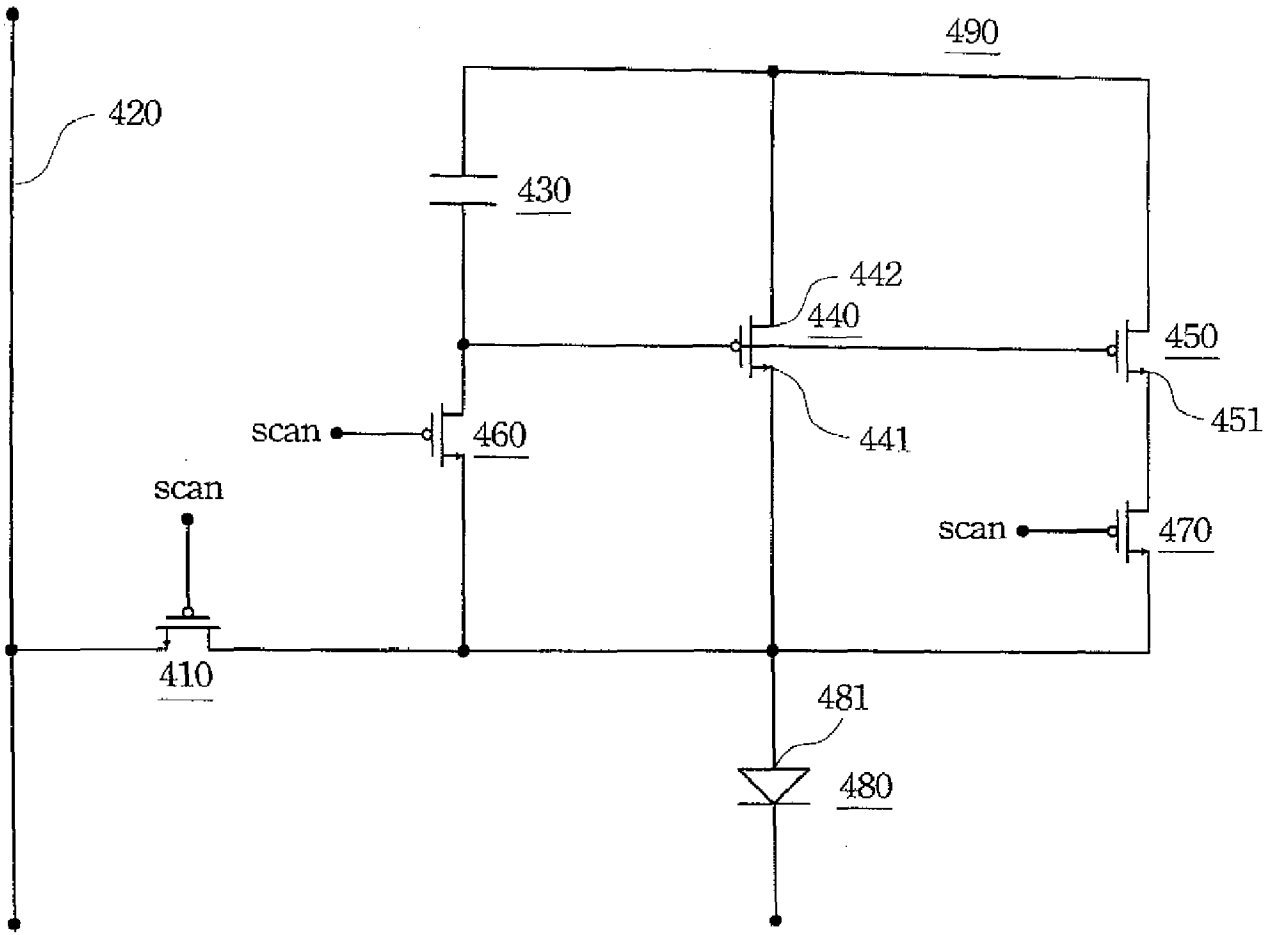
FIG. 4 shows an organic light emitting diode pixel circuit according to the third embodiment of the invention.

FIG. 4 shows an organic light emitting diode pixel circuit according to the third embodiment of the invention. The pixel circuit has a light emitting diode 480, a first driving transistor 440, a second driving transistor 450, a capacitor 430, and a switch unit. The first driving transistor 440 has a first source/drain coupled to a first end 481 of the light emitting diode 480. The second driving transistor 450 has a gate coupled to a gate of the first driving transistor 440, wherein the gate width of the second driving transistor 450 is smaller than the gate width of the first driving transistor 440. The capacitor 430 is coupled between the gate and a second source/drain 442 of the first driving transistor 440.

The switch unit has transistors 460 and 470. When a scan signal is asserted, the switch unit couples the first sources/drain 451 of the second driving transistor 450 to the first source/drain 441 of the first driving transistor 440, and couples the gate and the first source/drain 441 of the first driving transistor 440 together. When the scan signal is de-asserted, the switch unit decouples the first source/drain 451 of the second driving transistor 450 from the first source/drain 441 of the first driving transistor 440, and decouples the gate from the first source/drain 441 of the first driving transistor 440.

The pixel circuit further has a scan switch 410 coupled to a data line 420 and controlled by the scan signal. The second source/drain 442 of the first driving transistor 440 is coupled to a power source terminal 490, wherein variance of a voltage of the power source terminal 490 is opposite to the variance of the scan signal. In this embodiment, the switch unit configured with transistors 460 and 470, the first driving transistor 440, the second driving transistor 450, and the scan switch 410 are PMOS transistors.

Figure 5:
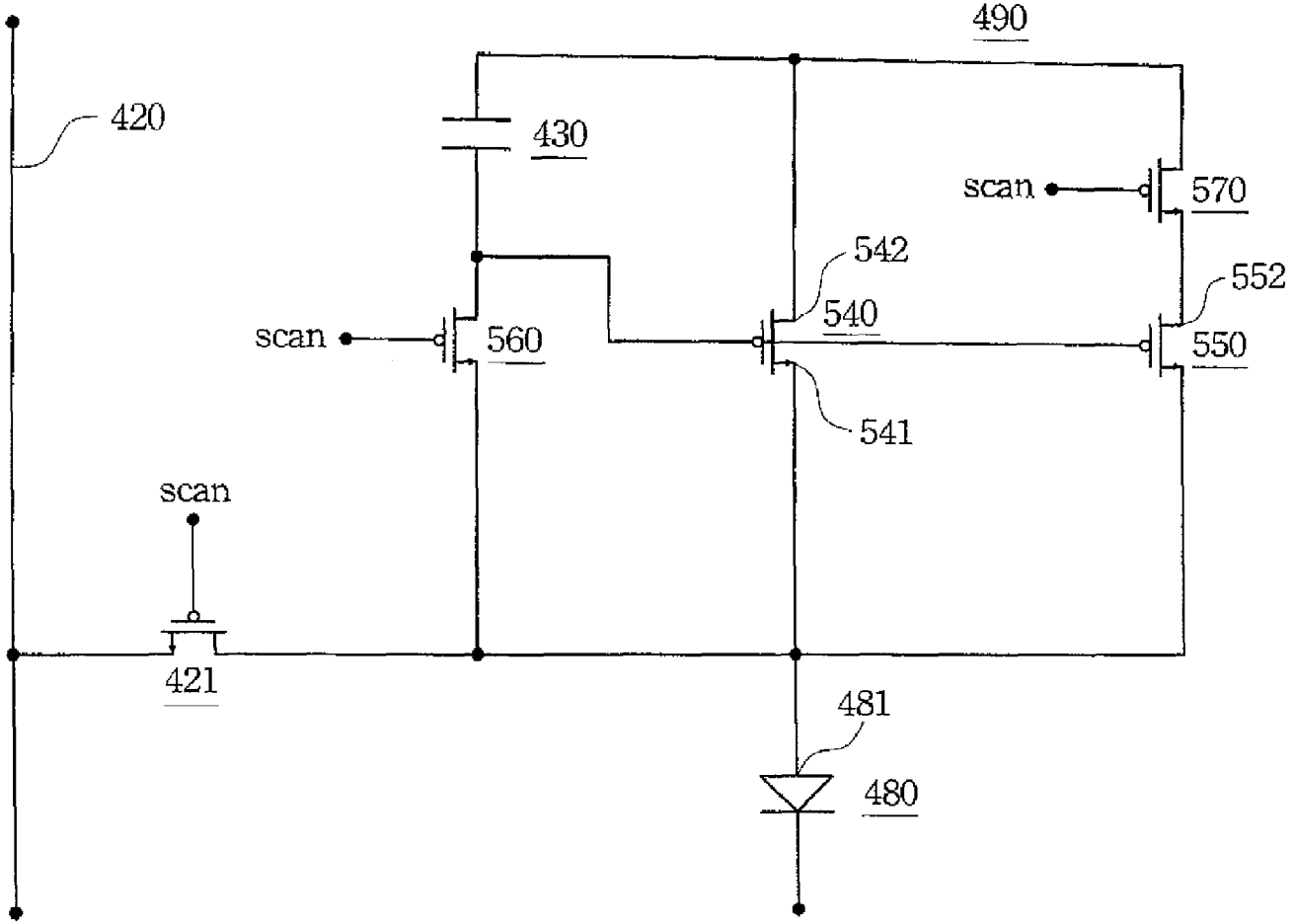
FIG. 5 shows an organic light emitting diode pixel circuit according to the fourth embodiment of the invention.

FIG. 5 shows an organic light emitting diode pixel circuit according to the fourth embodiment of the invention. The pixel circuit is configured with PMOS transistors, and the gate width of the second driving transistor 550 is smaller than the gate width of the first driving transistor 540. The difference between the pixel circuits of FIG. 5 and FIG. 4 is that the transistor 570 of FIG. 5 is coupled between the power source terminal 490 and the second driving transistor 550.

The switch unit has transistors 560 and 570. When a scan signal is asserted, the switch unit couples the second sources/drain 552 of the second driving transistor 550 to the second source/drain 542 of the first driving transistor 540, and couples the gate and the first source/drain 541 of the first driving transistor 540 together. When the scan signal is de-asserted, the switch unit decouples the second source/drain 552 of the second driving transistor 550 from the second source/drain 542 of the first driving transistor 540, and decouples the gate from the first source/drain 541 of the first driving transistor 540.

Figure 6:
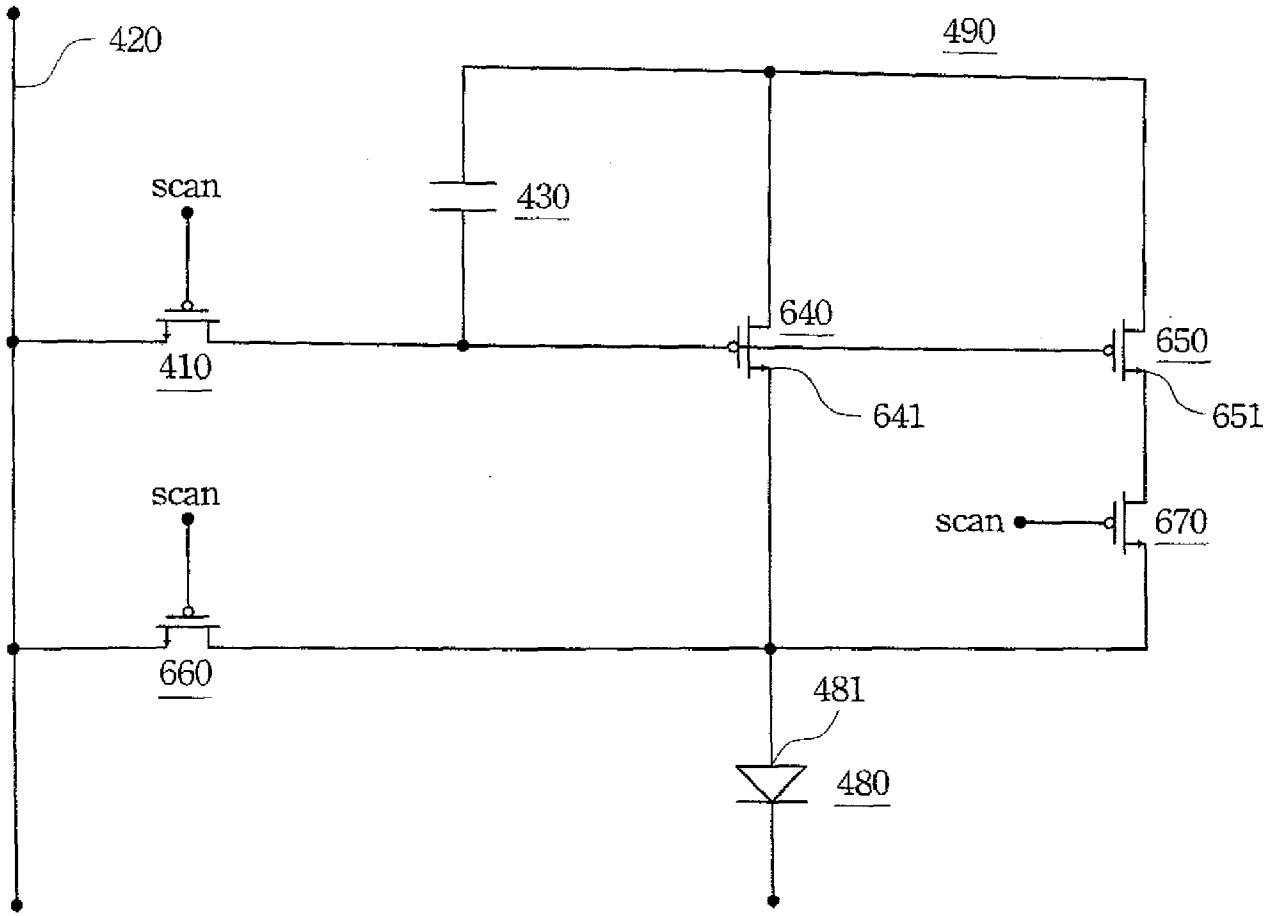
FIG. 6 shows an organic light emitting diode pixel circuit according to the fifth embodiment of the invention.

FIG. 6 shows an organic light emitting diode pixel circuit according to the fifth embodiment of the invention. The pixel circuit is configured with PMOS transistors, and the gate width of the second driving transistor 650 is smaller than the gate width of the first driving transistor 640. The difference between the pixel circuits of FIG. 6 and FIG. 4 is that the transistor 660 of FIG. 6 is coupled between the data line 420 and the first source/drain 641 of the first driving transistor 640.

The switch unit has transistors 660 and 670. When a scan signal is asserted, the switch unit couples the first sources/drain 651 of the second driving transistor 650 to the first source/drain 641 of the first driving transistor 640, and couples the gate and the first source/drain 641 of the first driving transistor 640 together. When the scan signal is de-asserted, the switch unit decouples the first source/drain 651 of the second driving transistor 650 from the first source/drain 641 of the first driving transistor 640, and decouples the gate from the first source/drain 641 of the first driving transistor 640.

Figure 7:
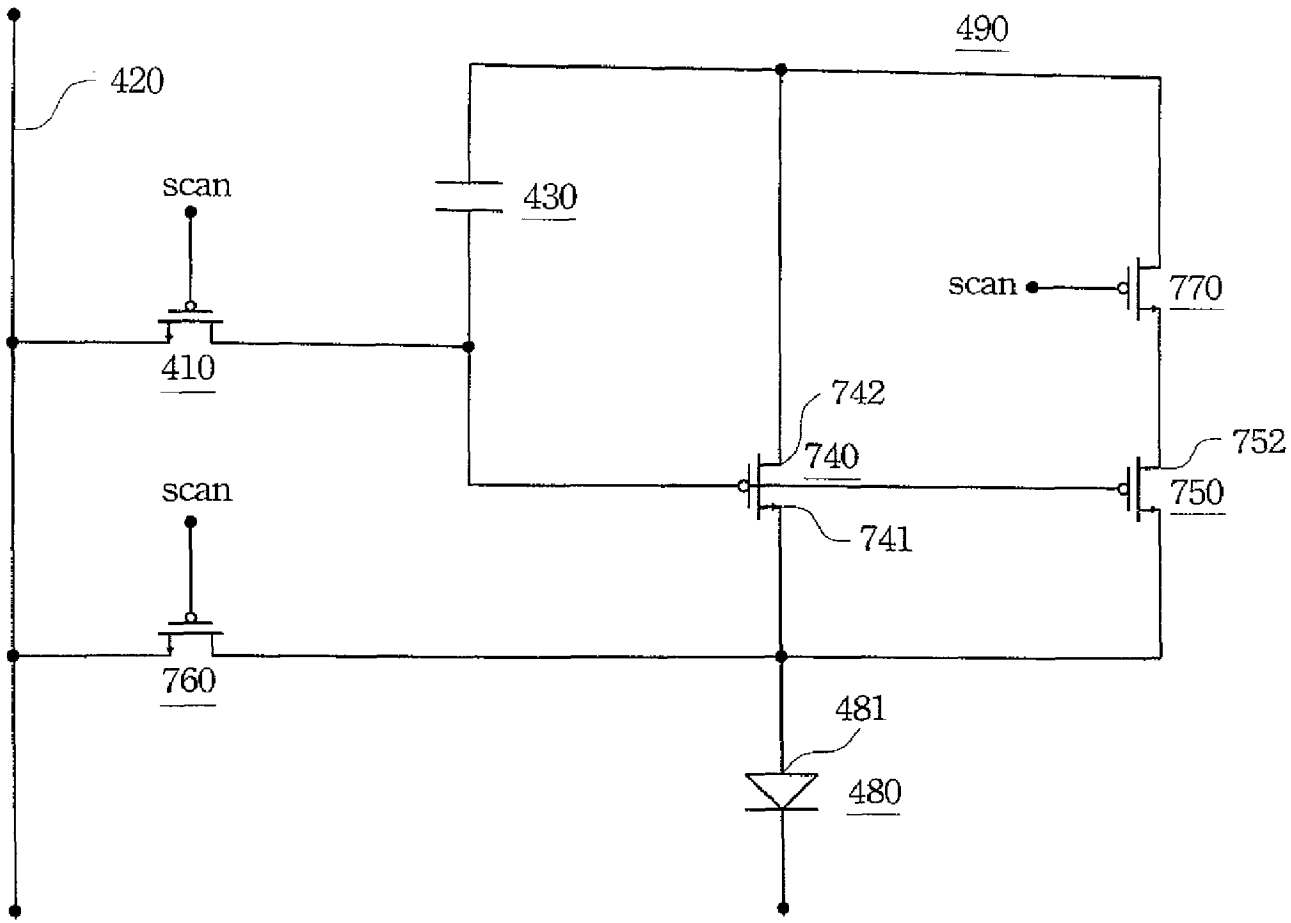
FIG. 7 shows an organic light emitting diode pixel circuit according to the sixth embodiment of the invention.

FIG. 7 shows an organic light emitting diode pixel circuit according to the sixth embodiment of the invention. The pixel circuit is configured with PMOS transistors, and the gate width of the second driving transistor 750 is smaller than the gate width of the first driving transistor 740. The difference between the pixel circuits of FIG. 7 and FIG. 6 is that the transistor 770 of FIG. 7 is coupled between the power source terminal 490 and the second source/drain 752 of the second driving transistor 750.

The switch unit has transistors 760 and 770. When a scan signal is asserted, the switch unit couples the second sources/drain 752 of the second driving transistor 750 to the second source/drain 742 of the first driving transistor 740, and couples the gate and the first source/drain 741 of the first driving transistor 740 together. When the scan signal is de-asserted, the switch unit decouples the second source/drain 752 of the second driving transistor 750 from the second source/drain 742 of the first driving transistor 740, and decouples the gate from the first source/drain 741 of the first driving transistor 740.

Figure 8:
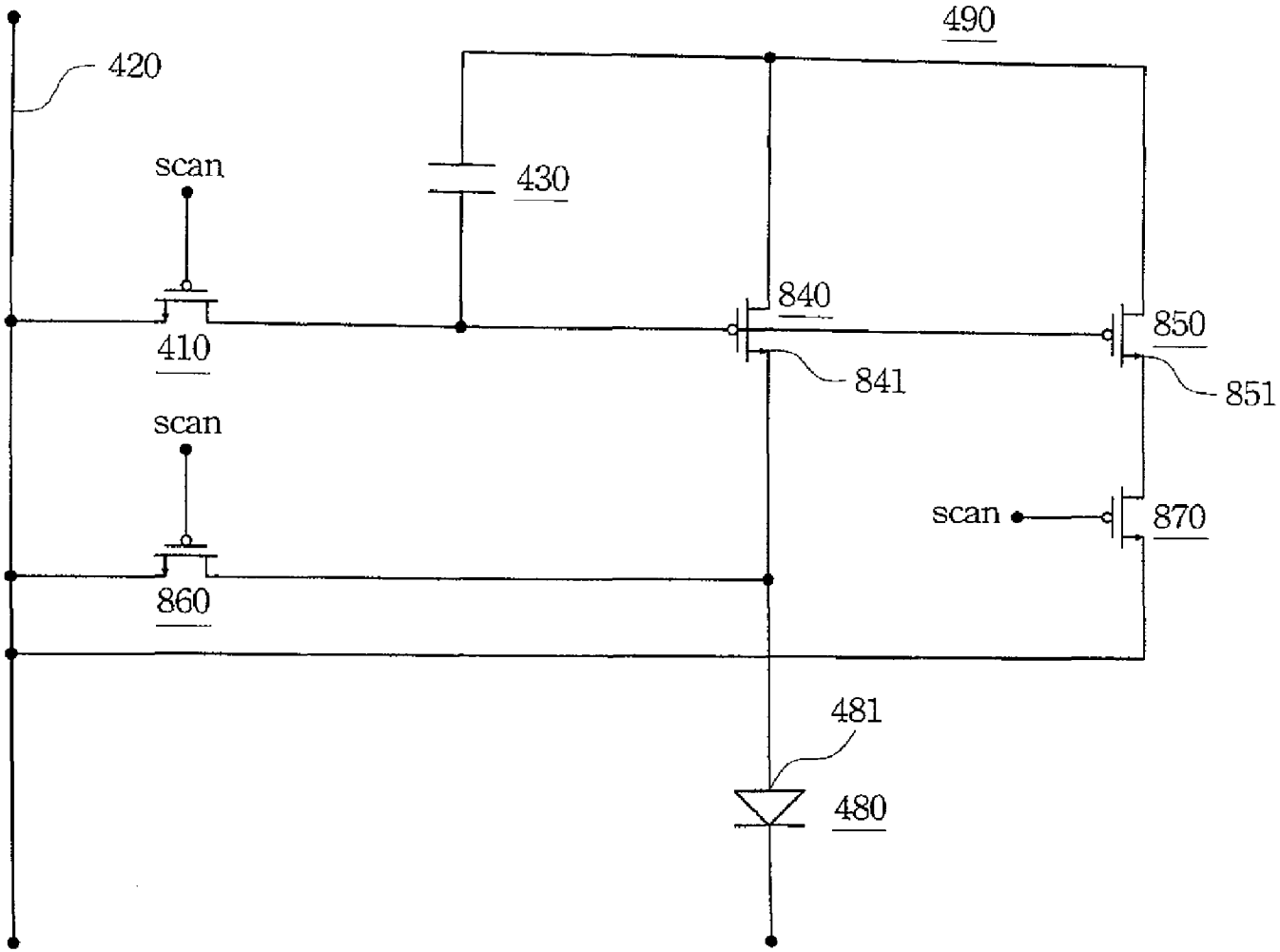
FIG. 8 shows an organic light emitting diode pixel circuit according to the seventh embodiment of the invention.

FIG. 8 shows an organic light emitting diode pixel circuit according to the seventh embodiment of the invention. The pixel circuit is configured with PMOS transistors, and the gate width of the second driving transistor 850 is smaller than the gate width of the first driving transistor 840. The difference between the pixel circuits of FIG. 8 and FIG. 6 is that the transistor 870 of FIG. 8 is coupled between the data line 420 and the first source/drain 851 of the second driving transistor 850.

The switch unit has transistors 860 and 870. When a scan signal is asserted, the switch unit couples the first sources/drain 851 of the second driving transistor 850 to the first source/drain 841 of the first driving transistor 840, and couples the gate and the first source/drain 841 of the first driving transistor 840 together. When the scan signal is de-asserted, the switch unit decouples the first source/drain 851 of the second driving transistor 850 from the first source/drain 841 of the first driving transistor 840, and decouples the gate from the first source/drain 841 of the first driving transistor 840.

Figure 9:
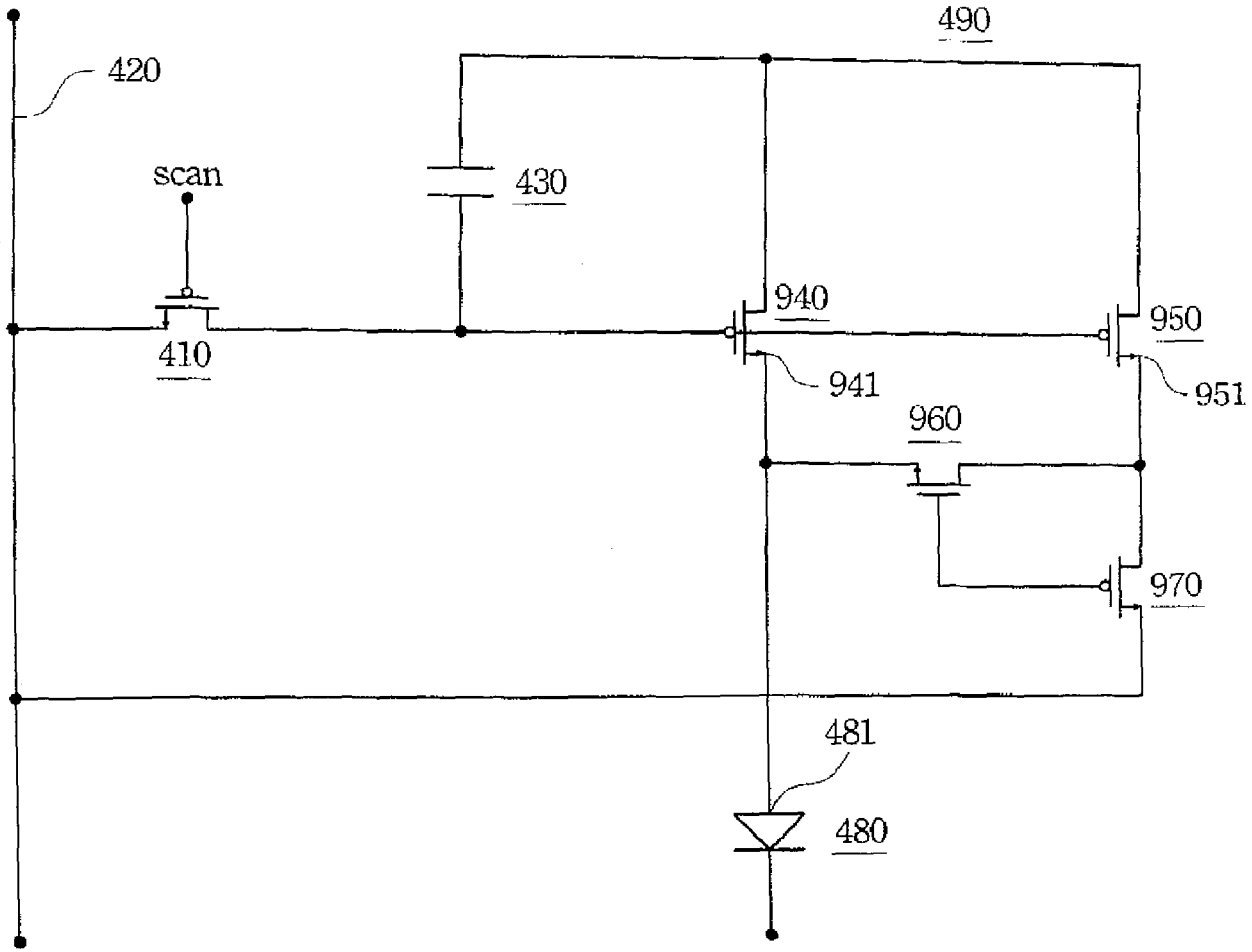
FIG. 9 shows an organic light emitting diode pixel circuit according to the eighth embodiment of the invention.

FIG. 9 shows an organic light emitting diode pixel circuit according to the eighth embodiment of the invention. The pixel circuit is configured with PMOS transistors, and the gate width of the second driving transistor 950 is smaller than the gate width of the first driving transistor 940. The difference between the pixel circuits of FIG. 9 and FIG. 6 is that the transistor 960 of FIG. 9 is coupled between the first source/drain 941 of the first driving transistor 940 and the first source/drain 951 of the second driving transistor 950.

The switch unit has transistors 960 and 970. When a scan signal is asserted, the switch unit couples the first sources/drain 951 of the second driving transistor 950 to the first source/drain 941 of the first driving transistor 940, and couples the gate and the first source/drain 941 of the first driving transistor 940 together. When the scan signal is de-asserted, the switch unit decouples the first source/drain 951 of the second driving transistor 950 from the first source/drain 941 of the first driving transistor 940, and decouples the gate from the first source/drain 941 of the first driving transistor 940.

Figure 10:
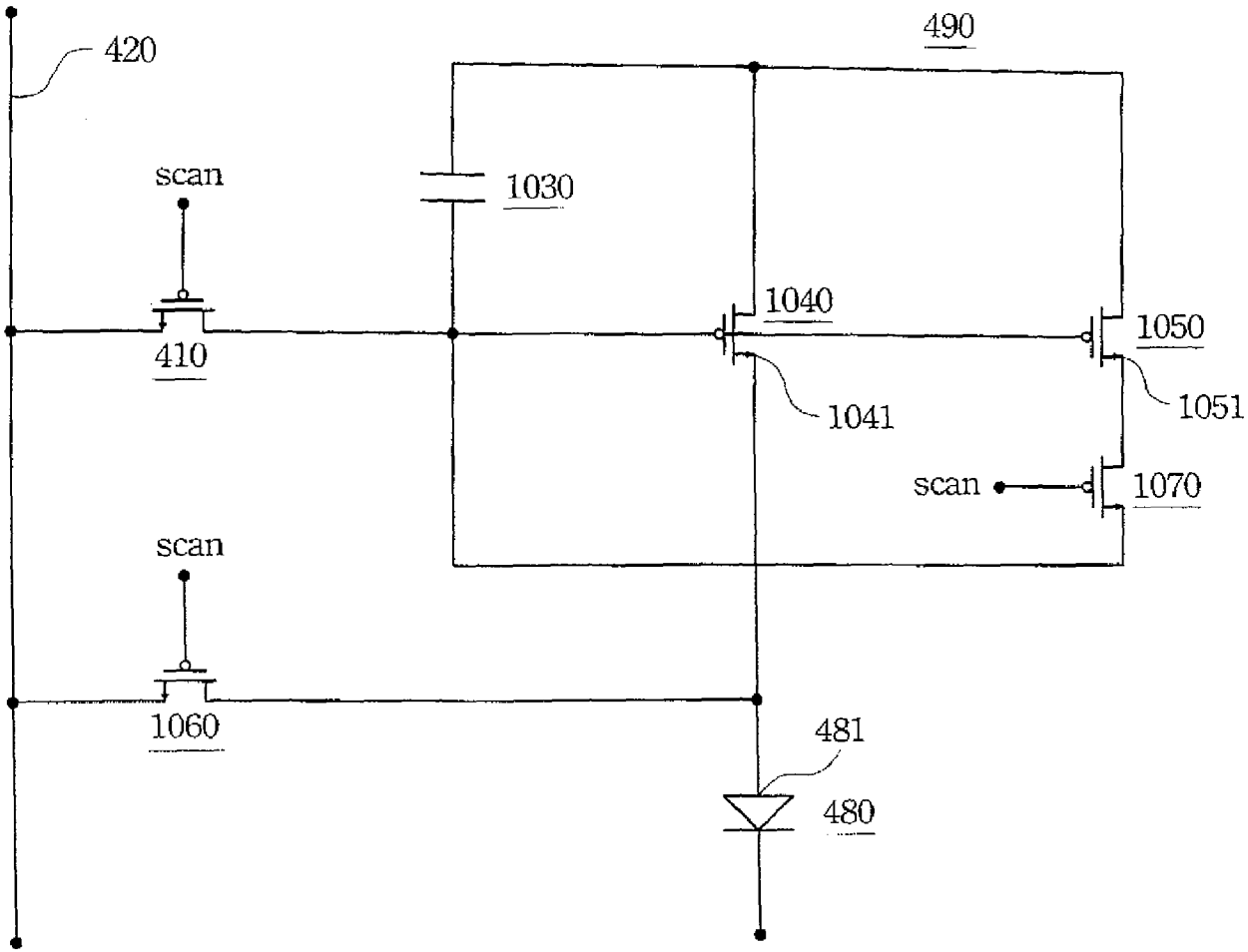
FIG. 10 shows an organic light emitting diode pixel circuit according to the ninth embodiment of the invention.

FIG. 10 shows an organic light emitting diode pixel circuit according to the ninth embodiment of the invention. The pixel circuit is configured with PMOS transistors, and the gate width of the second driving transistor 1050 is smaller than the gate width of the first driving transistor 1040. The difference between the pixel circuits of FIG. 10 and FIG. 6 is that the transistor 1070 of FIG. 10 is coupled between the capacitor 1030 and the first source/drain 1051 of the second driving transistor 1050.

The switch unit has transistors 1060 and 1070. When a scan signal is asserted, the switch unit couples the first sources/drain 1051 of the second driving transistor 1050 to the first source/drain 1041 of the first driving transistor 1040, and couples the gate and the first source/drain 1041 of the first driving transistor 1040 together. When the scan signal is de-asserted, the switch unit decouples the first source/drain 1051 of the second driving transistor 1050 from the first source/drain 1041 of the first driving transistor 1040, and decouples the gate from the first source/drain 1041 of the first driving transistor 1040.

Figure 11A:
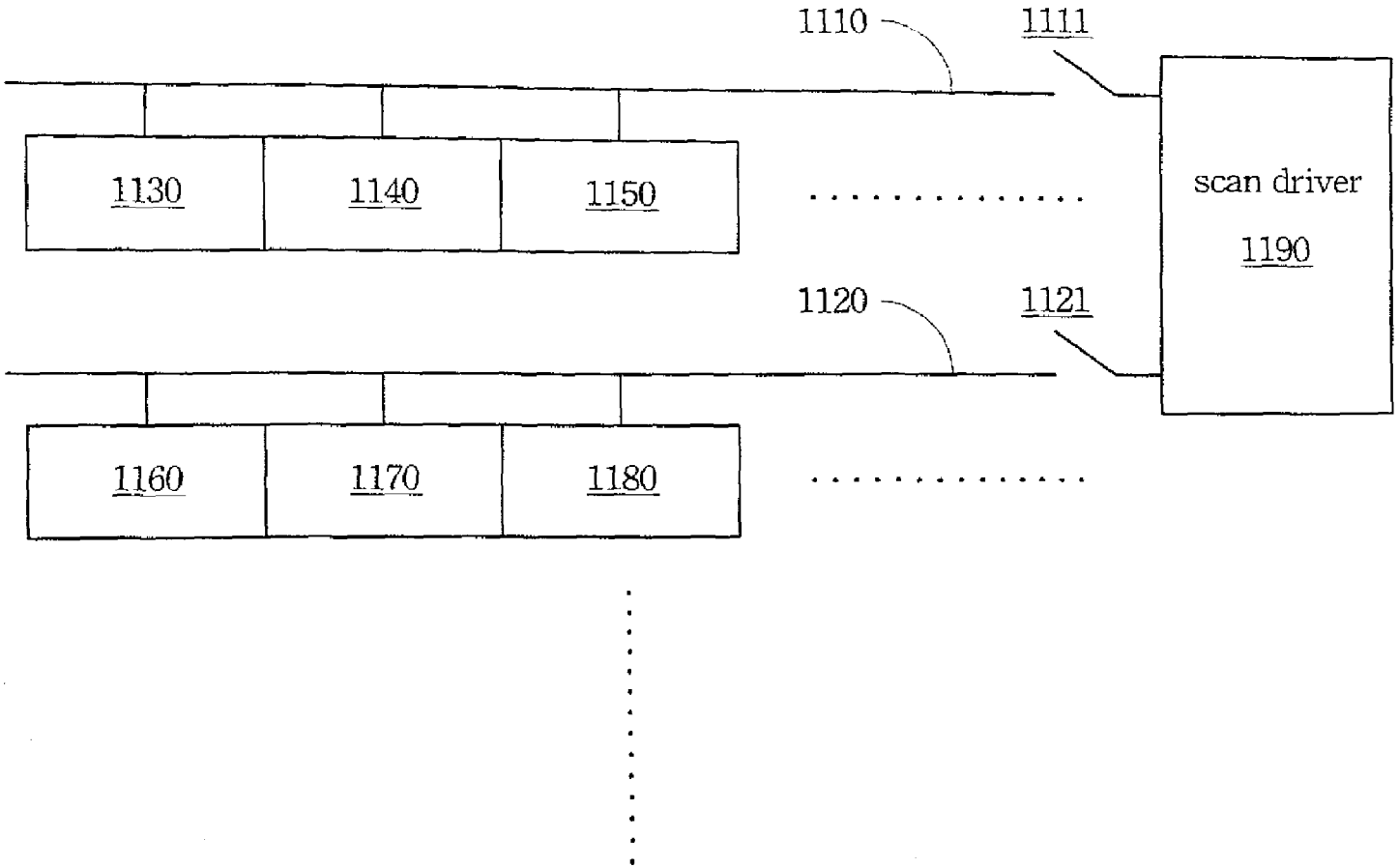
FIG. 11A shows a display panel according to the tenth embodiment of the invention.

FIG. 11A shows a display panel according to the tenth embodiment of the invention. This display panel has several pixel circuits and several scan lines. The embodiment takes two lines 1110, 1120, and several pixel circuits 1130, 1140, 1150, 1160, 1170 and 1180 for example. The pixel circuits 1130, 1140, 1150 are respectively coupled to the line 1110, and the pixel circuits 1160,1170, 1180 are respectively coupled to the line 1120. The line 1110 cooperates with the switch 1111 and the line 1120 cooperates with the switch 1121 and are arranged to transmit power source voltages from the scan driver (gate driver) 1190.

Figure 11B:
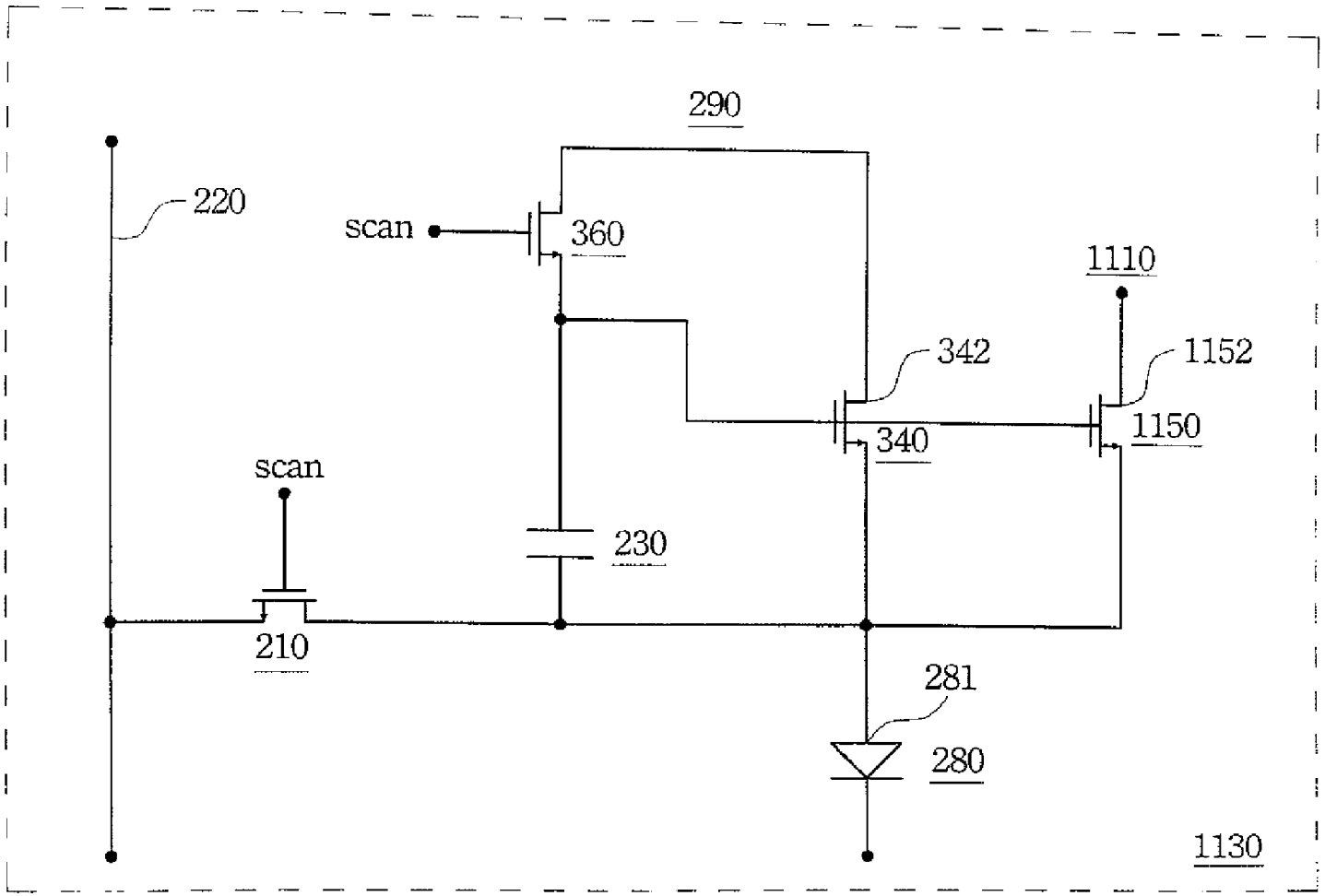
FIG. 11B shows an organic light emitting diode pixel circuit of the FIG. 11A.

FIG. 11B shows an organic light emitting diode pixel circuit of the FIG. 11A. This pixel circuit 1130 is modified from the FIG. 3. The transistor 370 of the switch unit in the FIG. 3 is omitted, therefore, the switch unit of FIG. 11B has only the transistor 360. The second source/drain 1152 of the second driving transistor 1150 is coupled to the scan line 1110. The variance of the voltages of the line 1110 is same as the variance of the scan signal. Therefore, each pixel circuit of the FIG. 11A can respectively save one transistor (corresponding to the transistor 360 of pixel circuit 1130) by this kind of design.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel circuit, comprising:

a light emitting diode;

a first driving transistor having a gate, a first source/drain, and a second source/drain, wherein the first source/drain is directly coupled to one end of the light emitting diode;

a second driving transistor having a gate, wherein the gate is directly coupled to the gate of the first driving transistor, wherein a gate width of the second driving transistor is smaller than a gate width of the first driving transistor;

a capacitor directly coupled between the gate of the first driving transistor and the first source/drain of the first driving transistor; and a switch unit, wherein:

when a scan signal is asserted, the switch unit is configured to couple sources/drains of the second driving transistor respectively to the first source/drain and the second source/drain of the first driving transistor, and to couple the gate and second source/drain of the first driving transistor together, and when the scan signal is de-asserted, the switch unit is configured to decouple one of the sources/drains of the second driving transistor from the first/second source/drain of the first driving transistor, and to decouple the gate from the second source/drain of the first driving transistor;

wherein the second source/drain of the first driving transistor is coupled to a power source terminal;

wherein a voltage of the power source terminal changes oppositely to a voltage of the scan signal for an entire period of the scan signal, the period defined as when the scan signal is both asserted and de-asserted.

2. The pixel circuit as claimed in claim 1, further comprising a scan switch coupled between a data line and the light emitting diode, wherein the scan switch is controlled by the scan signal.

3. The pixel circuit as claimed in claim 2, wherein the switch unit, the first driving transistor, the second driving transistor and the scan switch are MOS transistors.

4. The pixel circuit as claimed in claim 1, wherein the voltage of the power source terminal changes at substantially the same time as the voltage of the scan signal.

* * * * *